US007481004B2

(12) United States Patent
Krohmer et al.

(10) Patent No.: US 7,481,004 B2
(45) Date of Patent: Jan. 27, 2009

(54) ADJUSTABLE WORK PIECE POSITIONING TOOL

(75) Inventors: Steven Krohmer, Coon Rapids, MN (US); Richard White, Zimmerman, MN (US); James Frey, Edina, MN (US)

(73) Assignee: Rockler Companies Incorporated, Medina, MN (US)

( * ) Notice: Subject to any disclaimer, the term of this patent is extended or adjusted under 35 U.S.C. 154(b) by 36 days.

(21) Appl. No.: 11/675,704

(22) Filed: Feb. 16, 2007

(65) Prior Publication Data

US 2007/0221292 A1 Sep. 27, 2007

Related U.S. Application Data

(60) Provisional application No. 60/773,958, filed on Feb. 16, 2006.

(51) Int. Cl.
*B43L 7/10* (2006.01)

(52) U.S. Cl. ..... 33/465; 33/645

(58) Field of Classification Search ..... 33/465, 33/471, 495, 568, 573, 613, 645; 269/37
See application file for complete search history.

(56) References Cited

U.S. PATENT DOCUMENTS

| | | | | |
|---|---|---|---|---|
| 3,783,518 | A * | 1/1974 | Jones | 33/419 |
| 4,327,501 | A * | 5/1982 | Hurt | 33/465 |
| 4,562,649 | A | 1/1986 | Ciavarella | |
| 5,189,804 | A | 3/1993 | Ostachowski | |
| 5,732,474 | A | 3/1998 | Cannon | |
| 5,737,990 | A | 4/1998 | Freeland et al. | |
| 5,855,073 | A | 1/1999 | Boelling | |
| D426,427 | S | 6/2000 | Boelling | |
| 6,141,882 | A | 11/2000 | Syken | |
| 6,560,886 | B2 * | 5/2003 | Gullberg | 33/471 |
| 7,047,655 | B2 * | 5/2006 | Larsson | 33/471 |
| 2008/0034599 | A1 * | 2/2008 | Hamilton | 33/471 |

* cited by examiner

*Primary Examiner*—G. Bradley Bennett
(74) *Attorney, Agent, or Firm*—Westman, Champlin & Kelly, P.A.

(57) ABSTRACT

A work piece positioning tool is disclosed. The tool includes a first leg and a second leg that have work piece abutting surfaces. Cooperative pivoting elements adjacent an end portion of each of the first and second legs are used for connecting the legs together in a plurality of relative angular orientations. The tool can be used in combination with first and second workpieces and first and second clamps to hold the first and second work pieces together at a desired angle.

18 Claims, 8 Drawing Sheets

ADJUSTABLE WORK PIECE POSITIONING TOOL

CROSS-REFERENCE TO RELATED APPLICATION

The present application is based on and claims the benefit of U.S. provisional patent application Ser. No. 60/773,958, filed Feb. 16, 2006, the content of which is hereby incorporated by reference in its entirety.

BACKGROUND

Tools for use in aligning work pieces together are well known. For example, U.S. Pat. No. 5,855,073 shows a tool 10 for aligning work pieces at a right angle. This tool 10 is also shown in FIGS. 1 and 2 of the present disclosure. The tool 10 has a first leg 12 connected to a second leg 14, at a right angle, and is of one-piece construction. One or more clamps 50 are used to secure the tool to two work piece components to align them at a right angle to each other for further processing. As shown in U.S. Pat. No. 5,855,073, the tool 10 may also include slots to accommodate other tools such as drill bits, screw drivers, etc.

While the tool 10 illustrated in FIGS. 1 and 2 and in U.S. Pat. No. 5,855,073 has proved quite effective for aligning two work piece components at a right angle for further processing, it is limited to right angle orientations. One-piece tools of this type have proven quite useful for right angle clamping of work piece components. In addition, one-piece tools of this type have been proposed for other angular orientations (see, e.g., U.S. Pat. No. D426,127, where the smaller angle between two legs is 135°, and the larger angle between those legs is 225°). However, work piece component orientations can only be arranged with respect to the fixed angle (right angle or otherwise) of the one-piece tool.

SUMMARY

A work piece positioning tool is disclosed. The tool includes a first leg and a second leg that have work piece abutting surfaces. Cooperative pivoting elements adjacent an end portion of each of the first and second legs are used for connecting the legs together in a plurality of relative angular orientations. The tool can be used in combination with first and second workpieces and first and second clamps to hold the first and second work pieces together at a selected angle.

A method of using an adjustable work piece positioning tool includes positioning a first leg of the tool against a first work piece and a second leg of the tool against a second workpiece. An angular orientation between the first leg and the second leg is selected such that an angular orientation between the first work piece and the second work piece is substantially the same as the angular orientation between the first leg and the second leg. Clamps can be used to hold the first leg against the first work piece and second leg against the second work piece.

This Summary is provided to introduce a selection of concepts in a simplified form that are further described below in the Detailed Description. This Summary is not intended to identify key features or essential features of the claimed subject matter, is not intended to describe each disclosed embodiment or every implementation of the claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The present invention will be further explained with reference to the attached figures, wherein like structure elements are referred to by like reference numerals throughout the several views.

Figure 1:
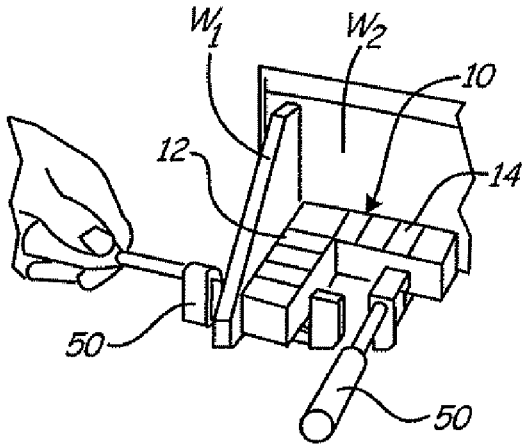
Fig. 1 (PRIOR ART)
FIG. 1 is a perspective view illustrating a prior art right angle tool 10 in use with clamps 50 on workpieces $W_1$ and $W_2$.
Figure 2:
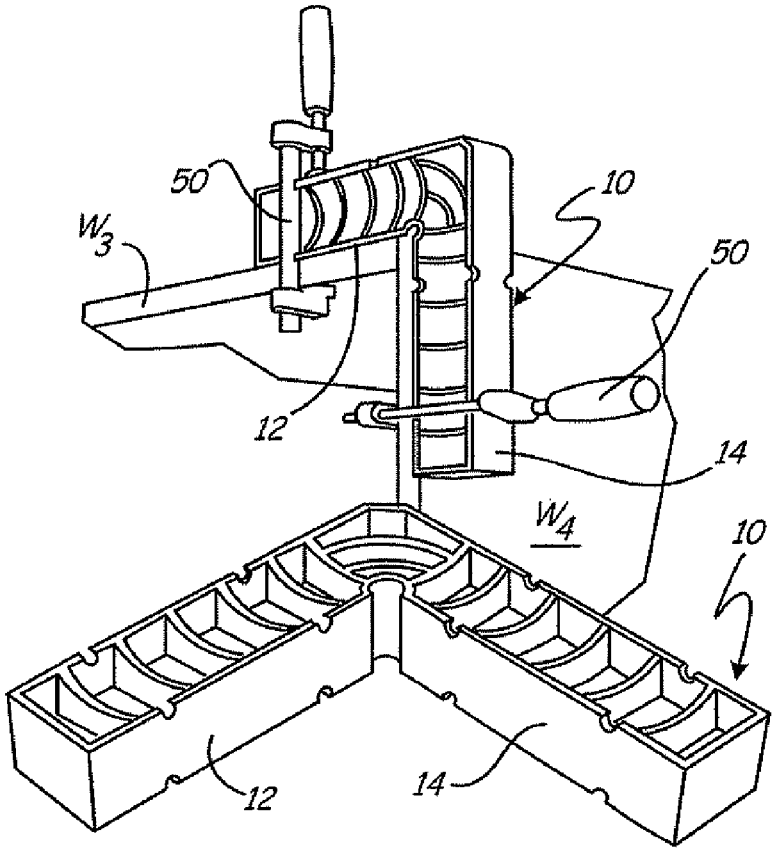
Fig. 2 (PRIOR ART)
FIG. 2 is a composite illustration, showing on the top portion thereof a perspective view illustrating a prior art right angle tool 10 in use with clamps 50, and on workpieces $W_3$ and $W_4$, and the bottom portion thereof showing a perspective view illustrating a right angle tool 10 alone.
Figure 3:
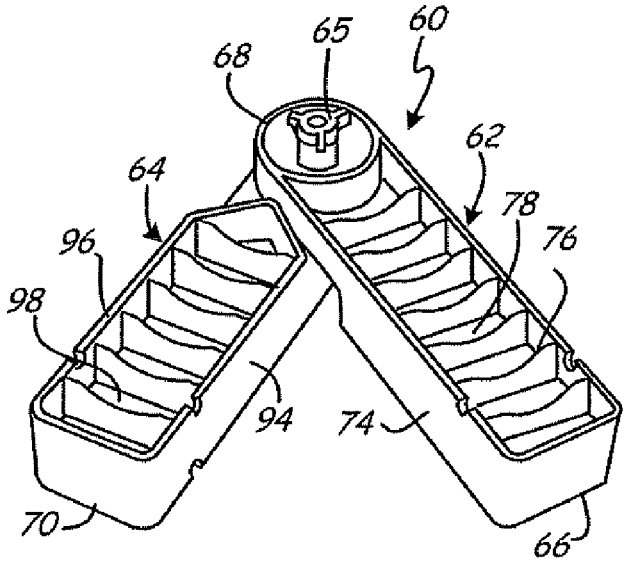
FIG. 3 illustrates an adjustable angle alignment tool of the present invention.

While the above-identified figures set forth one embodiment of the present invention, other embodiments are also contemplated, as noted in the disclosure. In all cases, this disclosure presents the invention by way of representation and not limitation. It should be understood that numerous other modifications and embodiments can be devised by those skilled in the art which fall within the scope and spirit of the principles of this invention.

DETAILED DESCRIPTION

FIGS. 3-7 illustrate an adjustable tool 60 of the present invention. The adjustable tool has a first leg 62 and a second leg 64. In one embodiment first leg 62 and second leg 64 are made from high-impact rigid polycarbonate for strength and accuracy. The first leg 62 has a free end 66 and a pivotal end 68. Second leg 64 likewise has a free end 70 and a pivotal end 72. The legs 62 and 64 are selectively held together and secured into a desired relative angular orientation by a tightening system which includes a tightening nut 65.

Adjacent its free end 66, the first leg 62 is generally "I" shaped in lateral cross section, with inner and outer parallel and planar flanges 74 and 76, respectively, provided on opposite sides of a central panel 78. On a top side of the central panel 78 (as seen in FIGS. 3, 6, 7, 8, 10 and 11), the central panel 78 has a peripheral rim 80 which is generally continuous from the free end 66 to the pivot end 68, with rim 80 projecting upwardly from the central panel 78. A plurality of lateral stiffening ribs 82 also project outwardly from the central panel 78, between the inner and outer flanges 74 and 76. The rim 80 is circular about a pivot shoulder 84 adjacent the pivot end 68 of the first leg 62.

Figure 12:
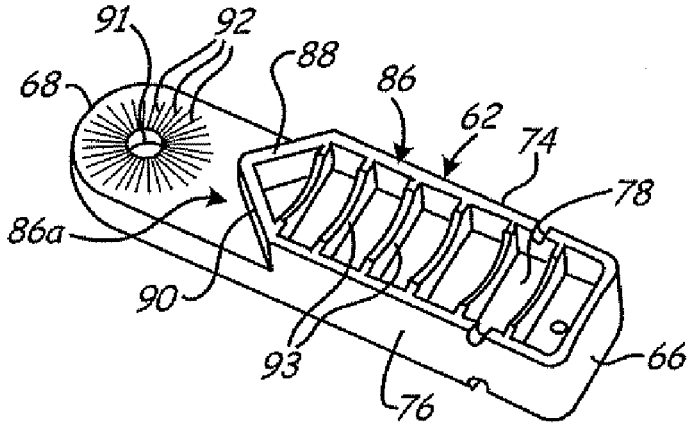

On its bottom side, central panel 78 also has a rim projecting therefrom, as shown by rim 86 in FIG. 12. Rim 86 extends from adjacent the free end 66 of the first leg 62 along its periphery but stops short of the pivot end 68 and has a pivot stop triangular wall portion 86*a* defined by angle walls 88 and 90 which are disposed at 45° angles relative to the inner flange 74 and outer flange 76, respectively. The pivot shoulder 84 on the top side of the central panel 78 is concentric about a pivot axis for the tool 10. On the bottom side of the central panel 78 (see FIG. 12), the first leg 62 has a female cylindrical bore 91, and a plurality of radially oriented rib or teeth features 92 formed thereon, both of which are also aligned about the pivot axis for the tool 10 (the rib or teeth features 92 radiate outwardly from the pivot axis). A plurality of lateral stiffening ribs 93 are also provided on the bottom side of the central portion 78, extending between the inner and outer flanges 74 and 76.

Adjacent its free end 70, the second leg 64 is also generally "I" shaped in lateral cross section, with inner and outer parallel and planar flanges 94 and 96, respectively, provided on opposite sides of a central panel 98. On a top side of the central panel 98 (as seen in FIGS. 3, 6, 7, 8, 10 and 14), the central panel 98 has a peripheral rim 99 which extends from the free end 70 but stops short of the pivot end 72 and has a pivot stop triangular wall portion 99*a* defined by angle walls 100 and 101 which are disposed at 45° angles relative to the inner flange 94 and outer flange 96, respectively. The rim 99 and angle walls 100 and 101 project upwardly from the central panel 98. A plurality of lateral stiffening ribs 102 also project upwardly from the central panel 98, between the inner and outer flanges 94 and 96.

Figure 13:
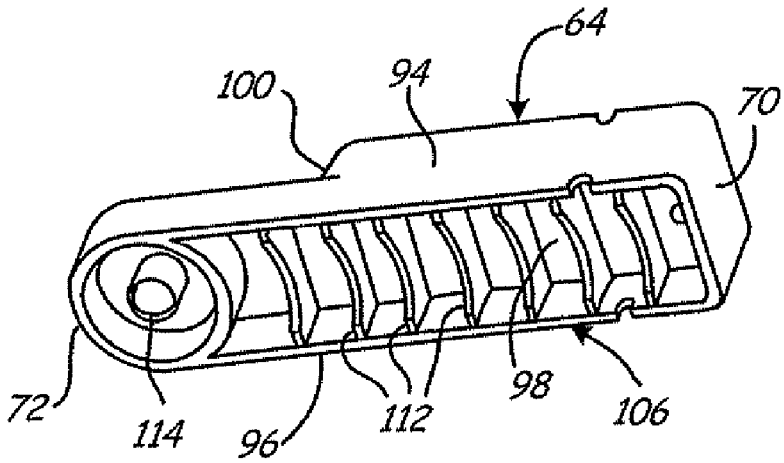
FIGS. 13 and 14 are perspective bottom and top views of a second leg of the adjustable angle tool of the present invention, respectively.
Figure 14:
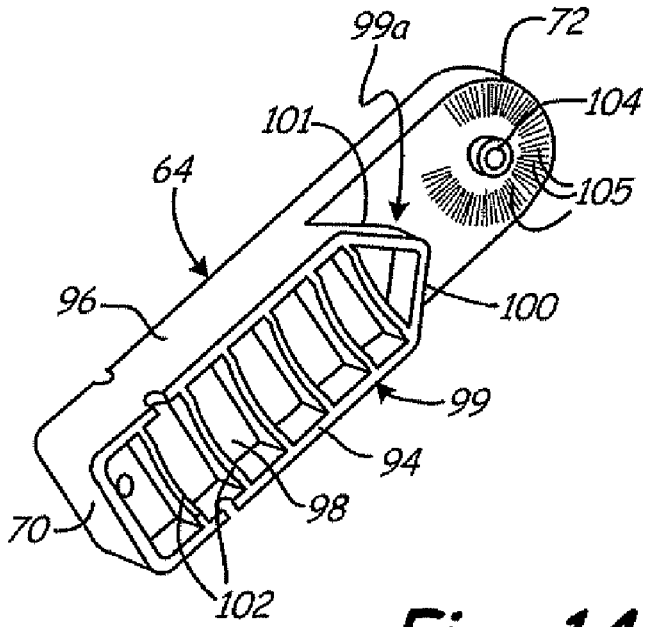

Adjacent to pivot end 72, a male cylindrical portion 104 projects upwardly from the central panel 98, concentric about the pivot axis for the tool 10. The male cylindrical portion 104 of the second leg 64 is formed to be pivotally received within the female cylindrical bore 91 of the first leg 62. A plurality of radially oriented rib or teeth features 105 are formed on the top side of the central panel 98 (see FIG. 14), and are aligned to radiate outwardly from the pivot axis of the tool 10. On its bottom side, central panel 98 has a peripheral rim projecting therefrom, as shown by rim 106 in FIG. 13. Rim 106 extends from adjacent the free end 70 of the second leg 64 and is generally continuous to the pivot end 72 thereof. A plurality of lateral stiffening ribs 112 also project outwardly from the bottom side of the central panel 98, between the inner and outer flanges 94 and 96. The rim 106 is circular about a pivot cylinder 114 adjacent to pivot end 72 of the first leg 64. The pivot cylinder 114 is also concentric about the pivot axis for the tool 10.

As so constructed, each leg is rigid and presents right angle surfaces between outer faces of each of its ribs and its respective inner planar flange, planar outer flange and free end (which is also formed as a generally planar panel). The first and second legs 62 and 64 are pivotally connected together by a tightening system about the pivot axis. The tightening system includes a tightening nut 65 which is typically threadably received on an axial threaded shaft 115 (see FIGS. 4, 5, 6 and 7). The shaft 115 is affixed to the second leg 64, may extend through the pivot cylinder 114 thereof, and projects upwardly from the top side of the central panel 98 of the second leg 64 through a hole in the pivot shoulder 84 of the first leg 62. When so assembled, the male cylindrical portion 104 is received within the female cylindrical bore 91. A spring 116 may be disposed between a bottom surface of the tightening nut 65 and the pivot shoulder 84 to assist in urging the components away from each other when the tightening nut 65 is not tightened down onto the threaded shaft 115 to allow for easier pivoting of first leg 62 with respect to second leg 64 without interference of pivoting elements on first leg 62 and second leg 64.

In operation, the tightening nut 65 is turned to loosen it on the threaded shaft 115 (moving away from the pivot shoulder 84), thereby allowing disengagement of the opposed rib or teeth features on the two legs and allowing relative pivoting of the first leg 62 and second leg 64. The legs may be pivoted through a range of motion illustrated in FIG. 5, so that they may be aligned relative to each other at angles ranging from 45° to 315°. Relative orientation of legs may be at any position from 45° to 315° in the embodiment illustrated (or may be incremental such as, for example, in 5° increments). The positions of the legs may be established by gradients, established by the interrelationship of the rib or teeth features 92 and 105 which are in engagement when the first and second legs 62 and 64 are secured together.

Figure 5:
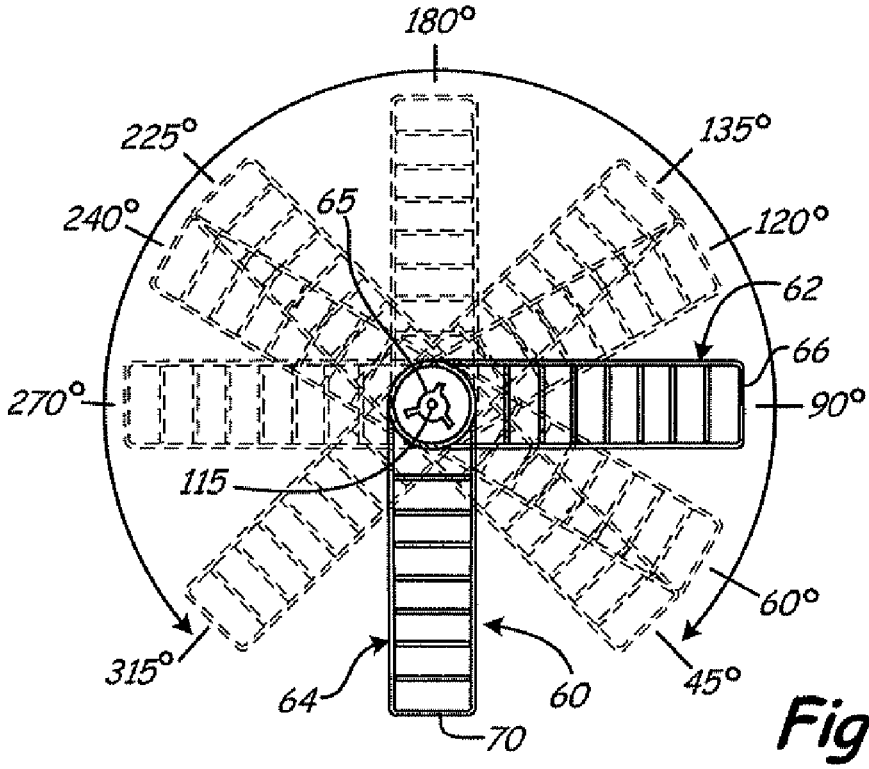
FIG. 5 illustrates the range of adjustability of the adjustable angle tool of the present invention, with many alternate tool positions shown in phantom.
Figure 6:
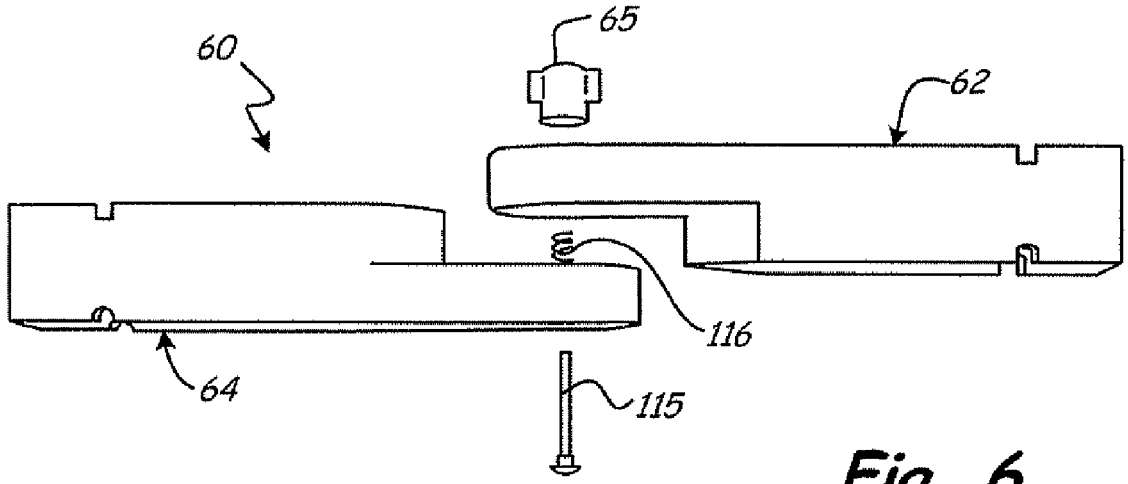
FIG. 6 is a side exploded view of the adjustable angle tool of the present invention.

FIG. 5 illustrates second leg 64 fixed in place (at the six o'clock position), with first leg 62 being moved through common angular orientations, with many of those orientations shown in phantom. Once a desired angular orientation is achieved, the tightening nut 65 is tightened down onto the threaded shaft 115 and against force of the spring thereon to securely fasten the first leg 62 relative to the second leg 64. The interfitting rib or teeth features 92 and 105 serve to additionally lock the first and second legs 62 and 64 in the desired orientation, so that they cannot be moved until the pressure exerted by the tightening nut 65 is released axially.

Figure 4:
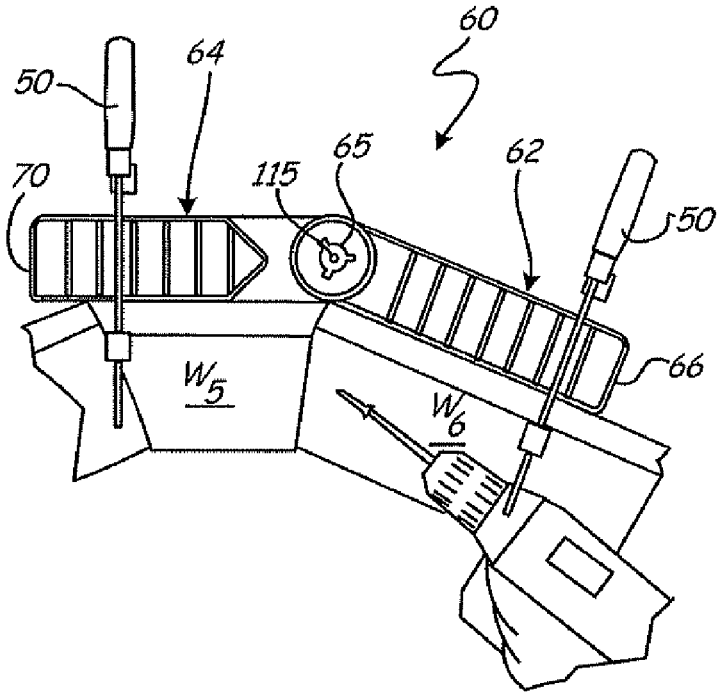
FIG. 4 illustrates the adjustable angle alignment tool of the present invention in use with a pair of clamps 50, on workpieces $W_5$ and $W_6$.

FIG. 4 illustrates the adjustable angle tool 60 of the present invention in use relative to work pieces $W_5$ and $W_6$. One or more clamps 50 include jaws are secured between a work piece face and one of the flanges on each of the legs of the adjustable tool 60. Prior to the work pieces being clamped in place relative to the adjustable tool 60, the adjustable tool 60 has been oriented to a desired angular orientation of the first and second legs 62 and 64 and the tightening system then activated to secure the legs in those relative orientations. In FIG. 4, that angular orientation is illustrated as approximately 170°.

Figure 8:
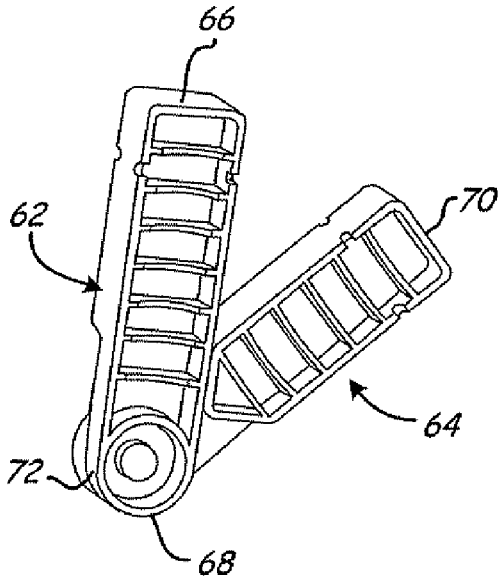
FIG. 8 is a top perspective view of the adjustable angle tool of the present invention, with a tightening system not shown.
Figure 9:
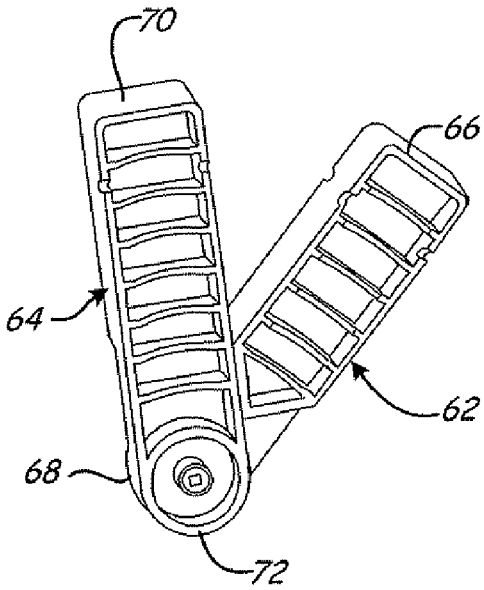
FIG. 9 is a bottom perspective view of the adjustable angle tool of the present invention, with the tightening system not shown.
Figure 10:
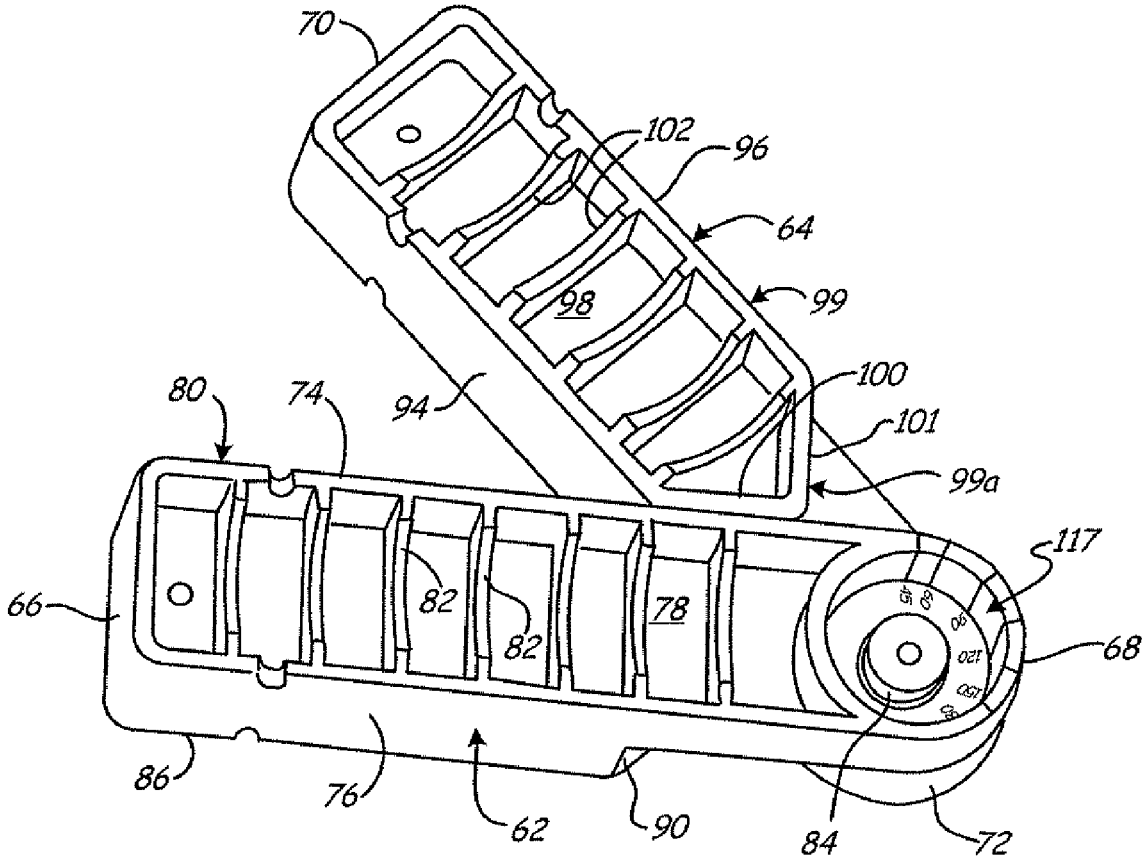
FIG. 10 is a top perspective view of the adjustable angle tool of the present invention, with the tightening system removed, and illustrating angular gradient indicia on one of the legs of the tool.
Figure 11:
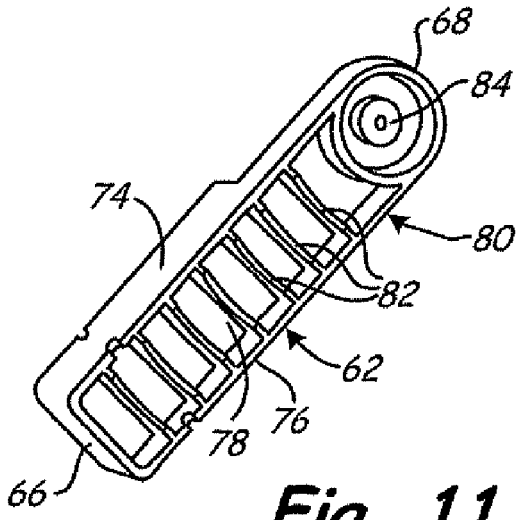
FIGS. 11 and 12 are perspective top and bottom views of a first leg of the adjustable angle tool of the present invention, respectively.

In FIG. 10, that angular orientation is illustrated as 45° as measured by the smaller angle between the legs (or 315° as measured by the larger angle between the legs). FIGS. 8 and 9 also illustrate a 45°/315° angular orientation. In the configurations shown in FIGS. 8, 9 and 10, one of the angle walls on each leg abuts a flange on the other leg. For instance, as seen in FIG. 10, the angle leg 100 on second leg 64 abuts the inner flange 74 on the first leg 62.

Figure 7:
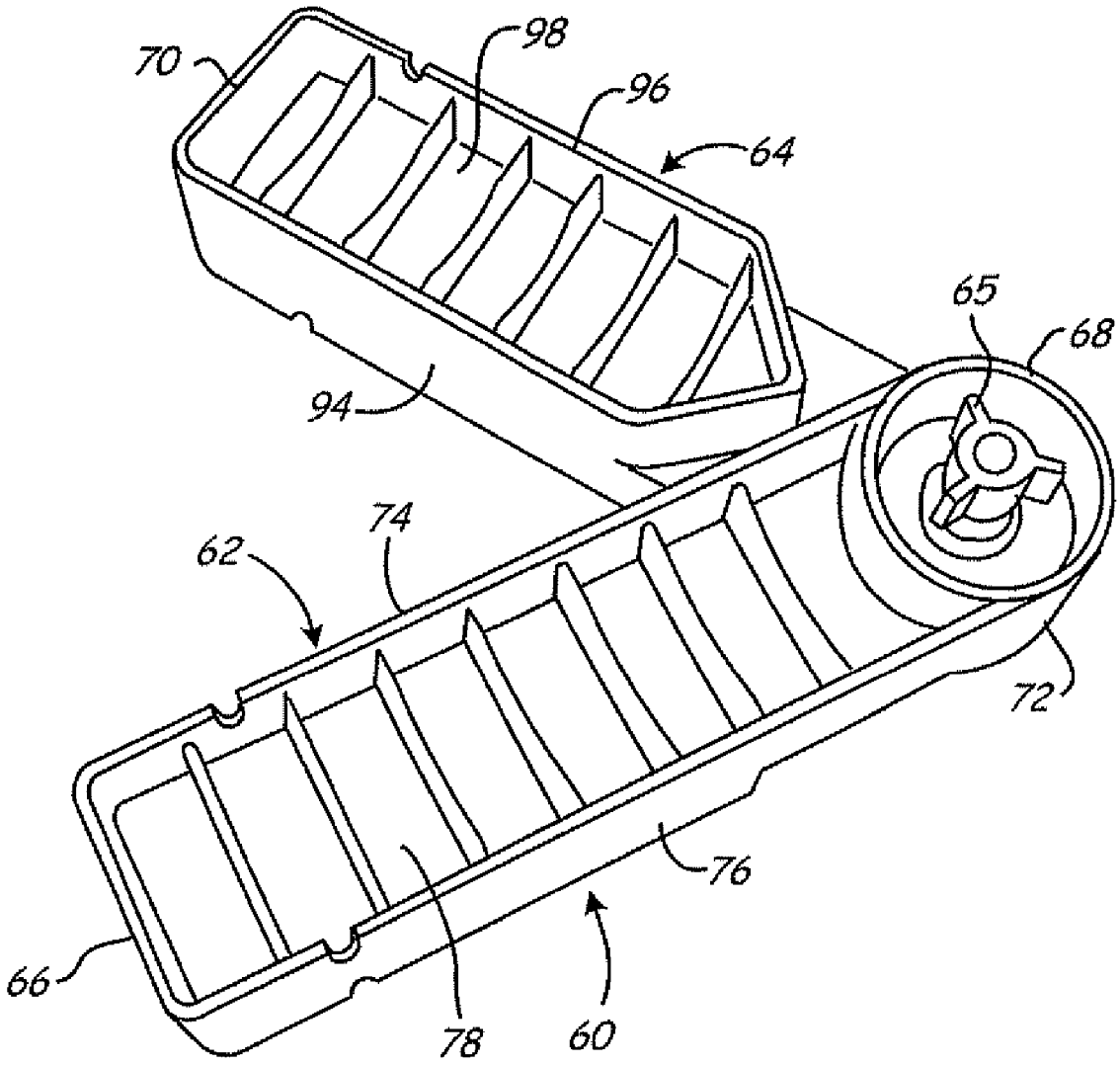
FIG. 7 is a perspective view of the adjustable angle tool of the present invention, from the top.

FIG. 7 illustrates the adjustable tool 60 in a 60° orientation as measured by the smaller angle between the legs (or a 300° orientation as measured by the larger angle between the legs). A user may be guided in aligning the two legs relative to one another by using visible angular indicia adjacent the pivot ends 68 and 72 of the first and second legs 62 and 64, respectively. Such indicia are illustrated in FIG. 10 as indicia 117, and may include opposed alignment marks on the two legs.

The adjustable angle tool of the present invention thus provides a device and method for establishing a predetermined angular orientation of the tool. Work pieces are disposed adjacent the tool and affixed thereto by clamps or other suitable means so that the work pieces assume the desired angular orientation. Once clamped to the adjustable angle tool of the present invention, further processing of the work pieces can then be accomplished (such as joining them together) while the work pieces are maintained in the desired angular orientation. Once the work pieces have been suitably joined or processed as desired, the clamps and adjustable angle tool can then be removed therefrom. The adjustable angle tool can then be reconfigured to a different angular orientation for further use, as desired.

Although the present invention has been described with reference to preferred embodiments, workers skilled in the art will recognize that changes may be made in form and detail without departing from the spirit and scope of the invention.

What is claimed is:

1. A work piece positioning tool comprising:

a first leg having work piece abutting surfaces;

a second leg having work piece abutting surfaces;

cooperative pivoting elements adjacent an end portion of each of the first and second legs for connecting the legs together in a plurality of relative angular orientations; and a spring adapted to urge the first leg away from the second leg.

2. The tool of claim 1 and further comprising a fastener adapted to selectively secure the end portion of the first leg to the end portion of the second leg.

3. The tool of claim 2 wherein the fastener includes a nut adapted to engage a threaded shaft.

4. The tool of claim 1 wherein the first leg and second leg both include a plurality of stiffening ribs positioned between their respective abutting surfaces.

5. The tool of claim 1 wherein at least one of the first leg and the second leg includes an angular travel stop angled with respect to at least one of its work piece abutting surfaces.

6. The tool of claim 1 wherein the cooperative pivoting elements include teeth positioned on both the first leg and the second leg in a radial pattern disposed about a pivoting axis.

7. The tool of claim 6 wherein the cooperative pivoting elements include a cylindrical portion projecting from the first leg and adapted to be received by a cylindrical bore in the second leg.

8. A combination, comprising:

a work piece positioning tool, comprising:

a first leg having a first flange and a second flange;

a second leg having a first flange and a second flange;

cooperative pivoting elements adjacent an end portion of each of the first and second legs for connecting the legs together in a plurality of angular orientations; and a spring adapted to urge the first leg away from the second leg;

a first work piece positioned against the first flange of the first leg;

a second work piece positioned against the first flange of the second leg;

a first clamp including jaws applying pressure to the second flange of the first leg and the first work piece; and a second clamp including jaws applying pressure to the second flange of the second leg and the second work piece.

9. The combination of claim 8 wherein the work piece positioning tool includes a fastener adapted to secure the end portion of the first leg to the end portion of the second leg in an angular orientation such that an angular orientation between the first work piece and the second work piece is substantially the same as the angular orientation between the first leg and the second leg.

10. The combination of claim 8 wherein the first leg and the second leg both include a plurality of stiffening ribs positioned between their respective first and second flanges.

11. The combination of claim 8 wherein the first leg includes a triangular wall portion connecting its first and second flange and the second leg includes a triangular wall portion connecting its first and second flange.

12. The combination of claim 8 wherein the cooperative pivoting elements include teeth positioned on both the first leg and the second leg in a radial pattern disposed about a pivoting axis of the work piece positioning tool.

13. The combination of claim 12 wherein the cooperative pivoting elements include a cylindrical portion projecting from the first leg and adapted to be received by a cylindrical bore in the second leg.

14. A method of holding a first work piece and a second work piece at an angular orientation, comprising:

adjusting an angular orientation between a first leg and a second leg of a work piece positioning tool to be substantially the same as the angular orientation between the first work piece and the second work piece, the first leg and the second leg being connected together about a pivot axis, wherein adjusting the angular orientation comprises loosening a fastener disposed at the pivot axis, moving the first and second legs relative to each other, and tightening the fastener;

positioning the first leg against the first work piece;

positioning the second leg against the second workpiece;

clamping the first leg to the first work piece; and clamping the second leg to the second work piece.

15. The method of claim 14 wherein the first leg includes a first flange and a second flange and wherein the second leg includes a first flange and a second flange.

16. The method of claim 15 wherein the first leg includes a plurality of stiffening ribs positioned between its first flange and second flange leg includes a plurality of stiffening ribs positioned between its first flange and second flange.

17. The method of claim 14 and further comprising:

providing cooperative pivoting elements on the first leg and second leg to orient the first leg with the second leg at selected angular orientations.

18. The method of claim 17 wherein the cooperative pivoting elements include teeth positioned on the first leg and the second leg.

* * * * *